US012168557B2

(12) United States Patent
Hirz

(10) Patent No.: US 12,168,557 B2
(45) Date of Patent: Dec. 17, 2024

(54) DEVICE FOR ACCURATELY CUTTING OFF A SEAL SECURING A CONTAINER

(71) Applicant: SSI SCHÄFER PLASTICS GMBH, Neunkirchen (DE)

(72) Inventor: Diethelm Hirz, Neunkirchen (DE)

(73) Assignee: SSI SCHÄFER PLASTICS GMBH, Neunkirchen (DE)

( * ) Notice: Subject to any disclaimer, the term of this patent is extended or adjusted under 35 U.S.C. 154(b) by 48 days.

(21) Appl. No.: 18/109,927

(22) PCT Filed: Aug. 3, 2021

(86) PCT No.: PCT/EP2021/071604
§ 371 (c)(1),
(2) Date: Feb. 15, 2023

(87) PCT Pub. No.: WO2022/037929
PCT Pub. Date: Feb. 24, 2022

(65) Prior Publication Data

US 2023/0406584 A1 Dec. 21, 2023

(30) Foreign Application Priority Data

Aug. 17, 2020 (DE) ..... 10 2020 121 536.3

(51) Int. Cl.
*B65D 55/06* (2006.01)

(52) U.S. Cl.
CPC ..... *B65D 55/06* (2013.01); *B65D 2401/60* (2020.05)

(58) Field of Classification Search
CPC .... B65D 55/06; B65D 2401/60; B65D 55/02; B65D 55/024
USPC ..... 220/277, 279, 280, 315, 293, 278
See application file for complete search history.

(56) References Cited

U.S. PATENT DOCUMENTS 6,350,418 B1 * 2/2002 Venderpool ..... B65D 55/12 292/37
2015/0083726 A1 3/2015 Zacchi
2020/0102126 A1 * 4/2020 Guerdrum ..... B65D 81/3813

FOREIGN PATENT DOCUMENTS

DE 102007051428 4/2009
EP 2810891 A1 * 12/2014 ..... A45C 1/06
EP 3170764 A1 * 5/2017 ..... B65B 7/28
FR 630514 A 12/1927

OTHER PUBLICATIONS

Diethelm Hirz, co-pending U.S. Appl. No. 18/016,940, filed Jan. 19, 2023, which is a national phase entry of PCT/EP2021/069290.

* cited by examiner

*Primary Examiner* — Rafael A Ortiz
(74) *Attorney, Agent, or Firm* — Smartpat PLC

(57) ABSTRACT

A device for accurately cutting off a seal securing the connection between a lid and a container or between parts of a container, as well as to a system consisting of a lid, a container, a seal, and a cutting device are disclosed. The cutting device makes it possible to open a closure secured with a seal without requiring any additional manipulations and renders the seal cutting process smooth.

16 Claims, 2 Drawing Sheets

DEVICE FOR ACCURATELY CUTTING OFF A SEAL SECURING A CONTAINER

TECHNICAL FIELD

The disclosure relates to a device for accurately cutting off a seal securing the connection between a lid and a container or between parts of a container, as well as to a system consisting of a lid, a container, a seal, and a cutting device.

BACKGROUND

Transport containers are usually sealed during shipping in order to indicate to a recipient whether they have been opened without authorization. The seals can be attached, for example, at a connection point between a lid and a container or also between parts of the container. Depending on the design of the seal, the seal is broken by releasing the connection or by an additional manual operation, such as manual slicing or cutting off.

In the industrial environment, additional work steps, in particular manual work steps, are disadvantageous since they are time-consuming and costly. Breaking the seal by lifting the lid is usually associated with uneven breaking of the seals, since there is typically a plurality of seals attached to one lid.

SUMMARY

An object of the disclosure is to reduce the number of work steps required to open connections secured with tamper proofing seals between a lid and a container or parts forming the container, or to make it easier to control the breaking of the tamper proofing seals. Hereafter, tamper proofing seals are referred to also as "seals" for short.

The object of the invention is achieved by a device and system as claimed. At least one separating device is arranged on a lid and/or the container, preferably on the lid, for accurately cutting off the seal. The separating device allows at least part of the seal to be separated when a closure mechanism is moved relative to the lid and/or container. The arrangement of the cutting device in conjunction with the defined movement of a closure mechanism ensures that the seal is cut off when the closure mechanism is actuated. This eliminates the additional manual process of cutting off, with scissors for example. Furthermore, the cutting device ensures that the cutting off process of the seal runs and remains reproducible even in the case of a plurality of closure mechanisms on one lid or a plurality of successive cutting off processes.

It is preferred if at least parts of the seal can be at least partially guided past the separating device by a movement of the closure mechanism. A seal or part of a seal can be cut off and/or sheared off as a result. This arrangement of the cutting device reduces the force required to break the seal.

The separating device ideally consists of a plate that is connected in a stationary manner to the lid or the container. The plate can be fixed to one or more surfaces, in particular a combination of reinforcing rib and lid/container surface. A seal can be easily broken on a fixed plate and plates are simple and inexpensive to make or connect, as the case may be, to the lid or container. Depending on the type, shape and/or material of the seal, the plate can also be made of the material of the lid or container and/or can be designed in one piece with it. Such a design is particularly advantageous for non-metallic seals.

Preferably, the plate has at least one edge for cutting off, preferably shearing off, the seal. The shearing off or cutting off of the seal can be facilitated by a corresponding design of at least one edge of the plate, for example in the form of a knife, an angle of the plate surfaces involved smaller than 45° relative to one another and/or a special grinding of the edge between the plate surfaces.

It is preferred that the plate be oriented with respect to the closure mechanism in such a manner that only one edge of the plate is suitable for shearing off the seal. This simplifies the manufacture of a suitable plate, in particular the used edge of the plate, and reduces unit costs.

Particularly preferably, more than one plate allocated to a single closure mechanism is arranged on the lid or container. This ensures that the seal is broken securely even if a plate is worn. Furthermore, the plates can be arranged relative to one another in such a manner that if one plate deforms, the other plates counteract such deformation.

The part of the seal guided through the aperture in the pin remains stuck to the edge of the first plate until the seal breaks when the pin is moved. This bends the pin in the direction of the plate or plate edge, as the case may be. However, due to the arrangement of the second and third plates in the wider field of movement of the pin, the pin is guided and held, and the resulting bending of the pin is at least limited. This increases the durability of the pin when moving and breaking the seal.

It is preferred if the closure mechanism has a pin and the pin has an aperture, preferably a bore. Thereby, the seal preferably consists at least partially of a wire or has a rod shape. "Rod shape" within the context of the disclosure means that at least the part that can be broken is formed to be rod-shaped. A part of the wire or rod-shaped seal is ideally guided in the securing state of the seal through the aperture in the pin and an associated aperture in the lid or container, preferably an aperture in a reinforcing rib of the lid or container. The aperture in the lid or in the container has a distance d from the aperture in the pin. d is the distance between the two facing surfaces of the apertures in the pin and in the lid. Such an arrangement can be easily secured by a seal, and when the closure mechanism is actuated in conjunction with the cutting device, the seal is securely broken. Preferably, d is minimal in the closed state of the closure mechanism.

Preferably, the plate has a height $H \geq d$. H is the height of the plate measured from the lid surface in which the aperture for the seal is. This presses one surface of the pin against the cutting device. Provided that a seal is arranged in the aperture of the pin, it is securely guided past the cutting device and can thus be broken, sheared off and/or cut off. This reduces the likelihood of the cutting device being skipped. Thereby, H is to be selected in such a manner that a permanent plastic deformation of the pin and/or the plate does not occur during the movement of the closure mechanism with and without the cutting off process of a seal. Ideally, the combination of pin, plate, seal is matched in such a manner that there is little, preferably no, abrasive wear between the plate and pin when the closure mechanism is moved.

Ideally, at least one guide for the pin is provided for reducing and/or preventing the springing up and guidance of the pin during movement. The guidance of the pin during movement improves the reproducibility of the cutting off process of the seal on the plate.

Furthermore, the object of the disclosure is achieved by a system comprising the disclosed device and at least one seal.

Preferably, the at least one seal is formed as a wire or rod-shaped element.

It is preferred that the at least one seal be guided along a separating device, bridging either a lid and a container or two adjacent parts of a container.

DETAILED DESCRIPTION

The invention is described in detail below with reference to the above figures in form and exemplary embodiment. In all figures, the same technical elements are marked with the same reference signs.

Figure 1:
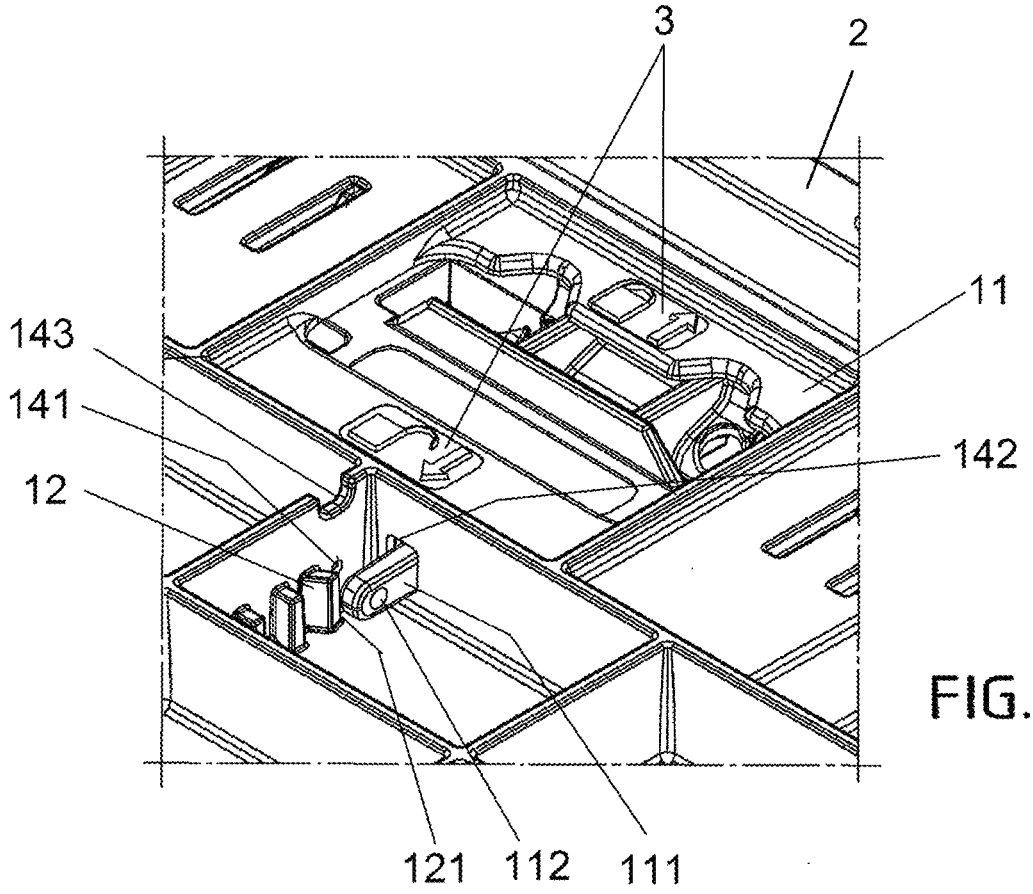
FIG. 1: Lid with a closure mechanism without a seal.

FIG. 1 shows a section of a lid 1 or a part of a container with a closure mechanism 11. The closure mechanism 11 is suitable, for example, for connecting a lid 1 to a container or two parts of the container. This connection can only be released by moving the closure mechanism 11. The lid 1 or container part, as the case may be, has a number of reinforcing ribs 14 that stiffen the lid 1 or container, as the case may be, and form a receptacle for the closure mechanism 11. A pin 111 with a circular aperture 112 is attached to the closure mechanism 11. An opening of the closure mechanism 11 also simultaneously moves the pin 111 with respect to the separating device.

The pin 111 itself is guided in movement by an aperture 142 in a reinforcing rib. A seal 13 designed as a wire can be guided through aperture 112 in a pin 111 and an associated aperture 141 in a reinforcing rib 14. An additional recess 143 in the reinforcing rib 14 fixes the wire-shaped seal 13 in place during a cutting off process.

The cutting device is formed by three successive plates 12. The plates 12 are arranged here on the reinforcing rib 14 of the lid 1 or container, as the case may be, and are designed in one piece with the reinforcing rib 14. The first plate 12 is arranged in manner rotating relative to the reinforcing rib 14 in such a manner that one edge 121 of the first plate 12 is preferably used to cut off the seal 13. The other two plates 12 are attached at right angles to the reinforcing rib 14. Due to an elastic deformation of the second or third plate 12, as the case may be, in particular the twisting with respect to the direction of movement of the pin 111, during the movement of the pin 111 along the plates 12, the edge 121 facing the pin 111 becomes preferably usable as a separating edge.

Figure 2:
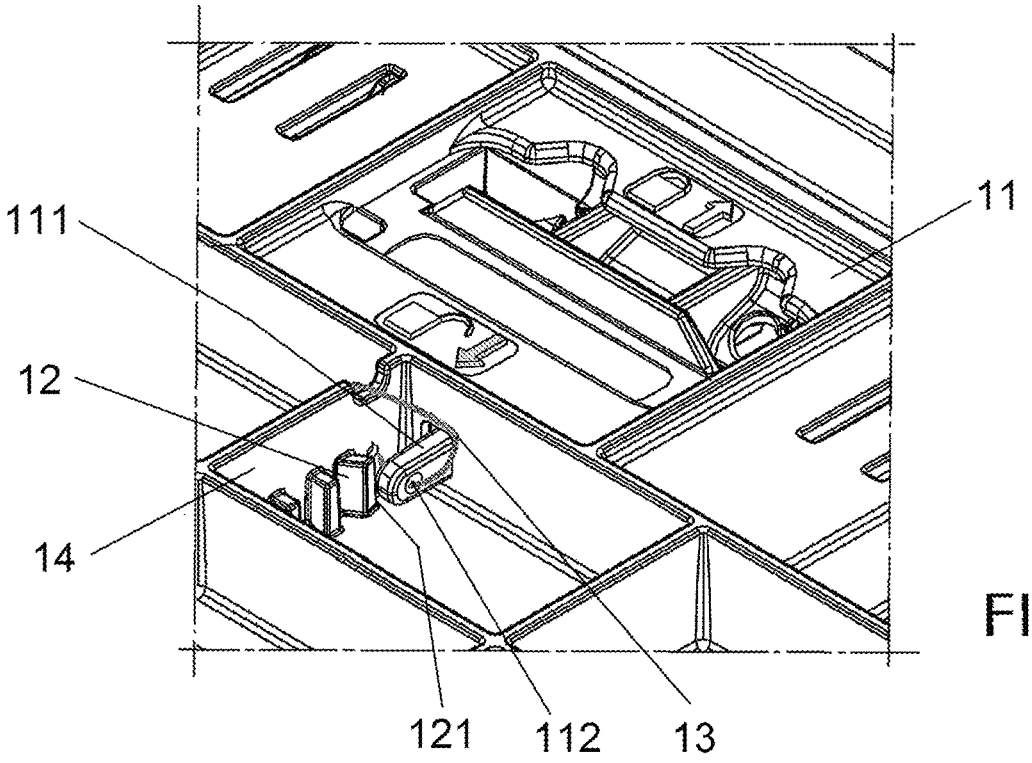
FIG. 2: Lid with a closure mechanism with a wire seal.

FIG. 2 shows the section of FIG. 1 with a wire-shaped seal 13 in the closed secured state of the closure mechanism 11. When the closure mechanism 11 is opened, the pin 111 is moved and also the part of the seal 13 guided through the opening 112 of the pin 111. Through the movement of the pin 111, the edge 121 of the first plate 12 slides along the surface of the pin 111, separating the wire-shaped seal 13.

Figure 3:
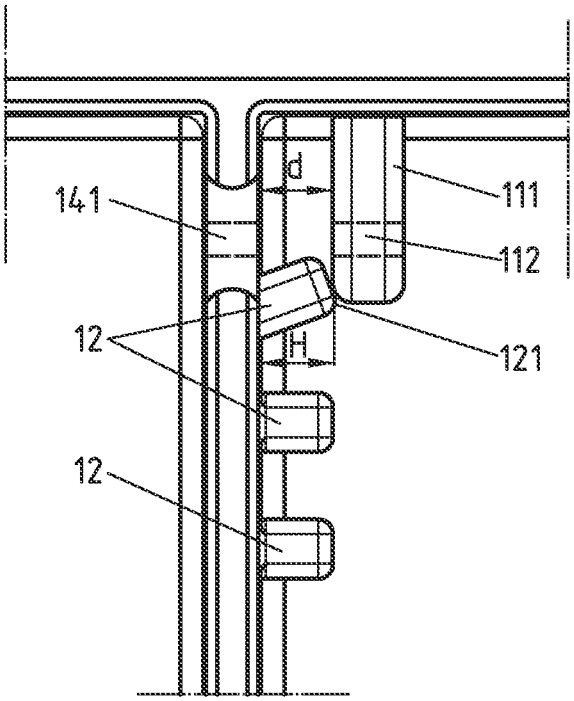
FIG. 3: Top view of lid with a closure mechanism.

FIG. 3 shows a top view of a region of a lid 1 for a container 2 with a separating device consisting of three plates 12 and a pin 111. The plates 12 are attached to a reinforcing rib 14 of the lid 1, wherein the edge 121 for cutting off the seal 13 of the first plate 12 has a distance H from the reinforcing rib 14. The distance H is greater than the distance d, which is between the two facing aperture surfaces 121, 141 in the reinforcing rib 14 and the pin 111.

REFERENCE CHARACTERS

Number Description
1 Lid
11 Closure mechanism
111 Pin
112 Aperture for seal
12 Plate
121 Edge
13 Seal
14 Reinforcing rib
141 Aperture for seal
142 Aperture for guiding the pin
143 Recess
2 Container
3 Direction of movement of closure mechanism
d Distance of bores
H Height of plate

The invention claimed is:

1. A device for accurately cutting off a tamper proofing seal (3) that secures a connection between a lid (1) and a container (2), comprising:

a closure mechanism (11) configured to move within the lid (1) or the container (2) between a secured state in which the lid (1) is secured to the container (2) and an open state in which the lid (1) can be released from the container (2);

a pin (111) attached to the closure mechanism (11);

an aperture (112) extending through the pin (111);

an associated aperture (141) extending through a reinforcement rib (14) in the lid (1) or the container (2); and a plate (12) connected in a stationary manner to the reinforcement rib (14), the plate (12) having an edge (121) suitable for shearing off the tamper proofing seal (3), wherein the aperture (112) and the associated aperture (141) are aligned when the closure mechanism (11) is in the secured state and the tamper proofing seal (3) extends through the aperture (112) and the associated aperture (141), wherein the tamper proofing seal (3) is cut off at the edge (121) of the plate (12) when the closure mechanism (11) is moved relative to the lid (1) or the container (2).

2. The device according to claim 1, wherein a separating device is arranged on the lid (1).

3. The device according to claim 1, wherein at least parts of the tamper proofing seal (3) can be at least partially guided past a separating device by the movement of the closure mechanism (11).

4. The device according to claim 1, wherein a separating device comprises the plate (12).

5. The device according to claim 1, wherein the plate (12) is oriented with respect to the closure mechanism (11) such that only one edge (121) of the plate (12) is suitable for shearing off the tamper proofing seal (3).

6. The device according to claim 4, wherein more than one plate (12) allocated to a single closure mechanism (11) is arranged on the lid (1) or the container (2).

7. The device according to claim 4, wherein the aperture is in form of a bore (112), wherein the tamper proofing seal (3) comprises a wire or includes a rod shape, wherein a part of the wire or the rod-shaped tamper proofing seal (3) is guided in a securing state of the tamper proofing seal (3) through the aperture (112) in the pin (111) and an associated aperture in the lid (1) or in the container (2), and wherein the associated aperture (141) in the lid (1) or in the container (2) has a distance (d) from the aperture (112) in the pin (111).

8. The device according to claim 7, wherein the plate (12) has a height (H) and wherein H≥d.

9. The device according to claim 7, wherein a guide for the pin (111) is provided for reducing or preventing springing up and for guiding the pin (111) during the movement.

10. The device according to claim 6, wherein an angle of the plate (12) surface is smaller than 45° relative to one another plate.

11. The device according to claim 7, wherein the combination of the pin (111), the plate (12), and the tamper proofing seal (3) is matched to reduce abrasive wear between the plate (12) and the pin (111) when the closure mechanism (11) is moved.

12. The device according to claim 9, wherein guidance of the pin (111) during movement improves the reproducibility of the cutting-off process of the tamper proofing seal (3) on the plate (12).

13. A system comprising the device according to claim 1 and the tamper proofing seal (3).

14. The system according to claim 13, wherein the tamper proofing seal (3) is a wire-shaped or a rod-shaped element.

15. The system according to claim 13, wherein the tamper proofing seal (3) is guided along the separating device, and bridges the lid (1) and the container (2).

16. A device for accurately cutting off a tamper proofing seal (3) securing a connection between a first part and a second part of a container, wherein the first part has a closure mechanism (11) to move within the first part or the second part between a secured state in which the first part is secured to the second part and an open state in which the first part can be released from the second part;

a pin (111) attached to the closure mechanism (11);

an aperture (112) extending through the pin (111);

an associated aperture (141) extending through a reinforcement rib (14) in the first part or the second part; and a plate (12) is connected in a stationary manner to the reinforcement rib (14), the plate (12) having an edge (121) suitable for shearing off the tamper proofing seal (3), wherein the aperture (112) and the associated aperture (141) are aligned when the closure mechanism (11) is in the secured state and the tamper proofing seal (3) extends through the aperture (112) and the associated aperture (141), wherein the tamper proofing seal (3) is cut off at the edge (121) of the plate (12) when the closure mechanism (11) is moved relative to the first part or the second part.

* * * * *